US005894745A

United States Patent [19]

Lee

[11] Patent Number: 5,894,745

[45] Date of Patent: Apr. 20, 1999

[54] AGITATOR OF A WASHING MACHINE

[75] Inventor: Am-Gyu Lee, Kwangju, Rep. of Korea

[73] Assignee: Daewoo Electronics Co., Ltd., Rep. of Korea

[21] Appl. No.: 09/079,299

[22] Filed: May 15, 1998

[30] Foreign Application Priority Data

May 28, 1997 [KR] Rep. of Korea ..... 97-21142

[51] Int. Cl.[6] ..... D06F 13/00

[52] U.S. Cl. ..... 134/53; 134/133; 134/134

[58] Field of Search ..... 68/53, 133, 134, 68/215, 219; 74/57, 55

[56] References Cited

U.S. PATENT DOCUMENTS

| | | | |
|---|---|---|---|
| 2,320,230 | 5/1943 | Glisson | 68/215 |
| 4,170,882 | 10/1979 | Brenner et al. | 68/133 |
| 5,638,704 | 6/1997 | Kim et al. | 68/133 |
| 5,722,265 | 3/1998 | Cho | 68/134 |
| 5,775,137 | 7/1998 | Yanagisawa | 68/134 |
| 5,784,904 | 7/1998 | Youn | 68/134 |

FOREIGN PATENT DOCUMENTS

| | | | |
|---|---|---|---|
| 148221 | 8/1977 | United Kingdom | 68/133 |

*Primary Examiner*—Frankie L. Stinson
*Attorney, Agent, or Firm*—Pillsbury Madison & Sutro, LLP

[57] ABSTRACT

An agitator of washing machine has a washing shaft installed on a lower portion of a washing tub and extending upward to a bottom of the washing tub to be installed rotatively. A driving cam is installed on the washing shaft to rotate integrally with the washing shaft. A driven cam is installed around the washing shaft and contacts a surface of the driving cam to be driven by rotation of the driving cam. A moving bar of which one end contacts an outer surface of the driven cam and the other end extends upward into the washing tub through a hole formed on the bottom of the washing tub is provided such that the other end of the moving bar moves rotatively in the washing tub by rotation of the driven cam. A plate for forming rotating water flows which is formed in the other end of the moving bar moves rotatively integrally with the moving bar, thereby forming the rotating water flow flows in the washing tub. And, an elastic means tightly pushes the one end of the moving bar onto the surface of the driven cam. Therefore, an irregular rotating water flows are generated which prevent laundry gathering in the center of the washing tub from tangling. Accordingly the washing time is shortened, and the washing efficiency is enhanced.

16 Claims, 5 Drawing Sheets

AGITATOR OF A WASHING MACHINE

BACKGROUND OF THE INVENTION

1. Field of the Invention

The present invention relates to an agitator of a washing machine, and more particularly to an agitator of a washing machine for rotating washing water accommodated in a washing tub to wash laundry.

2. Description of the Prior Art

Generally, a washing operation of a washing machine consists of a plurality of processes, that is, a water supplying process for supplying washing water into a washing tub, a washing process for washing laundry with the washing water supplied through the water supplying process, a rinsing process for rinsing laundry washed through the washing process, and a dehydrating process for dehydrating laundry rinsed through the rinsing process.

A general washing machine which performs the above washing operation has, as shown in FIG. 1, an outer tub 110 installed in a casing 100, a washing tub 120 installed in the outer tub 110 for accommodating laundry ans water, a pulsator 130 mounted on the bottom of the washing tub 120 for rotating the washing water in the washing tub 120, a driving motor 140 disposed under the outer tub 110 for driving the pulsator 130, and a gear assembly 150 for transmitting the power of the driving motor 140 selectively to the pulsator 130 and the washing tub 120.

The outer tub 110 has a cylindrical shape which allows a rotating water flow generated during washing operation ans is suspended in the casing 100 by a suspending bar 180. One end of the suspending bar 180 is connected to a damper 160 attached on a low portion of a surface of the outer tub 110, and the other end of the suspending bar 180 is fixed on the upper portion of inner wall of the casing 100. Also, the washing tub 120 having a cylindrical shape is installed in the outer tub 110 rotatively. A plurality of holes 170 are formed on the wall of the washing tub 120 such that the washing water supplied into the washing tub 120 flows to the side of the outer tub 110 through the holes 170. Accordingly, levels of water in the washing tub 120 and the outer tub 110 are equal. Also, the dirty washing water and any sediments which are generated from the washing water during the dehydrating process are deposited to the outer tub 110 through the holes 170. And, the pulsator 130 installed on the bottom of the washing tub 120 rotates clockwise and counterclockwise by the driving motor 140 and the gear assembly 150.

In the washing process, the power of the driving motor 140 is transmitted to the pulsator 130 via the gear assembly 150, thereby the pulsator 130 rotates such that a water flow rotating in the washing tub 120 is formed. The washing process of laundry accommodated in the washing tub 120 by the rotating water flow generated by the pulsator 130 is performed. In the dehydrating process, the power of the driving motor 140 is transmitted to the washing tub 120 and the pulsator 130 via the gear assembly 150 such that the washing tub 120 and the pulsator 130 rotate integrally at high speed. At this time, by the centrifugal force generated by the rotation of the pulsator 130, the dehydrating process is performed. Also, when the pulsator 130 rotates clockwise and counterclockwise, the outer tub 110 strongly vibrates due to the rotation of the washing tub 120 and the washing water. The vibration is alleviated by the damper 160 attached on the outer surface of the outer tub 110.

As described above, in the conventional washing machine, as indicated by the direction of the arrow in FIG. 1, the laundry moves to the central portion of the washing tub 120 to be twisted by the rotating water flow generated when the pulsator 130 rotates clockwise and counterclockwise. Therefore, efficiency of the washing machine is reduced. That is, when the rotating water flows are generated in the washing tub 120, the laundry rotates to be scrubbed by the rotating water flow, thereby the washing process is performed. At this time, the laundry moves to the central portion of the washing tub 120 to be twisted by the rotating water flow. Since the laundry once twisted is not likely to be scrubbed even by the rotating water flow, too much washing time is wasted and the efficiency of washing declines.

Also, since the pulsator 130 rotates in the lower portion of the washing tub 120, the strong water flows are generated in the lower portion of the washing tub 120 so the water flow as a result becomes weak at the upper portion of the washing tub 120. Accordingly, when the amount of water accommodated in the water tub 120 is great, the laundry is sufficiently washed in the lower portion of the washing tub 120, but contrarily the laundry is not sufficiently washed in the upper portion of the washing tub 120. Moreover, according to the tendency for larger sized washing machines, the washing tub 120 with large capacity is being adopted, so the laundry is not sufficiently washed by the pulsator 130 installed in the bottom of the washing tub 120.

SUMMARY OF THE INVENTION

Therefore, the present invention has been proposed to overcome the above described problems in the prior art, and accordingly it is an object of the present invention to provide an agitator of washing machine which generates a rotating water flow that prevents laundry from gathering and tangling in the center of the washing tub and strikes laundry to shorten the washing time and of which the washing efficiency is enhanced respectively.

To achieve the above objects, the present invention provides an agitator of a washing machine comprising, a washing shaft installed on a lower portion of a washing tub and extending upward to a bottom of the washing tub to be installed rotatively, a driving cam installed on the washing shaft to rotate integrally with the washing shaft, a driven cam installed around the washing shaft and contacting a surface of the driving cam to be driven by rotation of the driving cam, a moving bar of which one end contacts an outer surface of the driven cam and the outer end extends upward into the washing tub through a hole formed on the bottom of the washing tub such that the other end moves rotatively in the washing tub by rotation of the driven cam, a plate for forming a rotating water flow which is formed at the other end of the moving bar to move rotatively integrally with the moving bar, thereby forming the rotating water flow in the washing tub, and an elastic means for tightly pushing the one end of the moving bar onto the surface of the driven cam.

Here, the driving cam can have a triangular shape or the driven cam can be composed of at least a pair of triangular-shaped cams. And, it is preferable that the driven cam is installed at 4 positions around the washing shaft. More preferably, the driving cam and the driven cams can be positioned linearly on the driving cam as the center criterion. The moving bar can move rotatively on the middle portion between one end and the other end as the center criterion. A plurality of projections can be formed on one surface of the plate for forming the rotating water flow so that the plate for forming the rotating water flow moves rotatively to strike laundry, thereby efficiency of washing laundry is enhanced.

The elastic means can be installed at the middle portion of the moving bar. And, a coil spring can be employed as the elastic means. The coil spring can be a pair of coil springs installed in opposite directions to each other.

Also, an agitator of washing machine in the present invention comprises a washing shaft installed on a lower portion of a washing tub and extending upward to a bottom of the washing tub to be installed rotatively, a triangular-shaped driving cam installed on the washing shaft to rotate integrally with the washing shaft, at least a pair of driven cams installed around the washing shaft and contacting a surface of the driving cam to be driven by rotation of the driving cams, a moving bar of which one end contacts an outer surface of the driven cams and the other end extends upward into the washing tub through a hole formed on the bottom of the washing tub such that the other end moves rotatively in the washing tub by rotation of the driven cams, a plate for forming a rotating water flow which is formed at the other end of the moving bar and a plurality of projections are formed on one surface to move rotatively integrally with the moving bar, thereby forming the rotating water flows in the washing tub, and an elastic means which is installed at the middle portion of the moving bar to tightly push the one end of the moving bar onto the surface of the driven cam.

Here, preferably the driven cam are installed at 4 positions around the washing shaft. Furthermore, the driving cam and the driven cams can be positioned linearly on the driving cam as the center criterion. The moving bar can move rotatively on the middle portion between one end and the other end as the center criterion. And, a coil spring can be employed as the elastic means. The coil spring can be a pair of coil springs installed in opposite directions to each other.

Therefore, an irregular rotating water flow generated in the washing tub prevents laundry from gathering in the center of the washing tub and tangling and conversely laundry is struck. Accordingly the washing time is shortened and the washing effect is enhanced.

BRIEF DESCRIPTION OF THE DRAWINGS

The above objects and other advantages of the present invention will become more apparent by describing in detail preferred embodiment thereof with reference to the attached drawings in which.

DETAILED DESCRIPTION OF THE PREFERRED EMBODIMENTS

Embodiments of the present invention will now be described below with reference to the figures.

Figure 1:
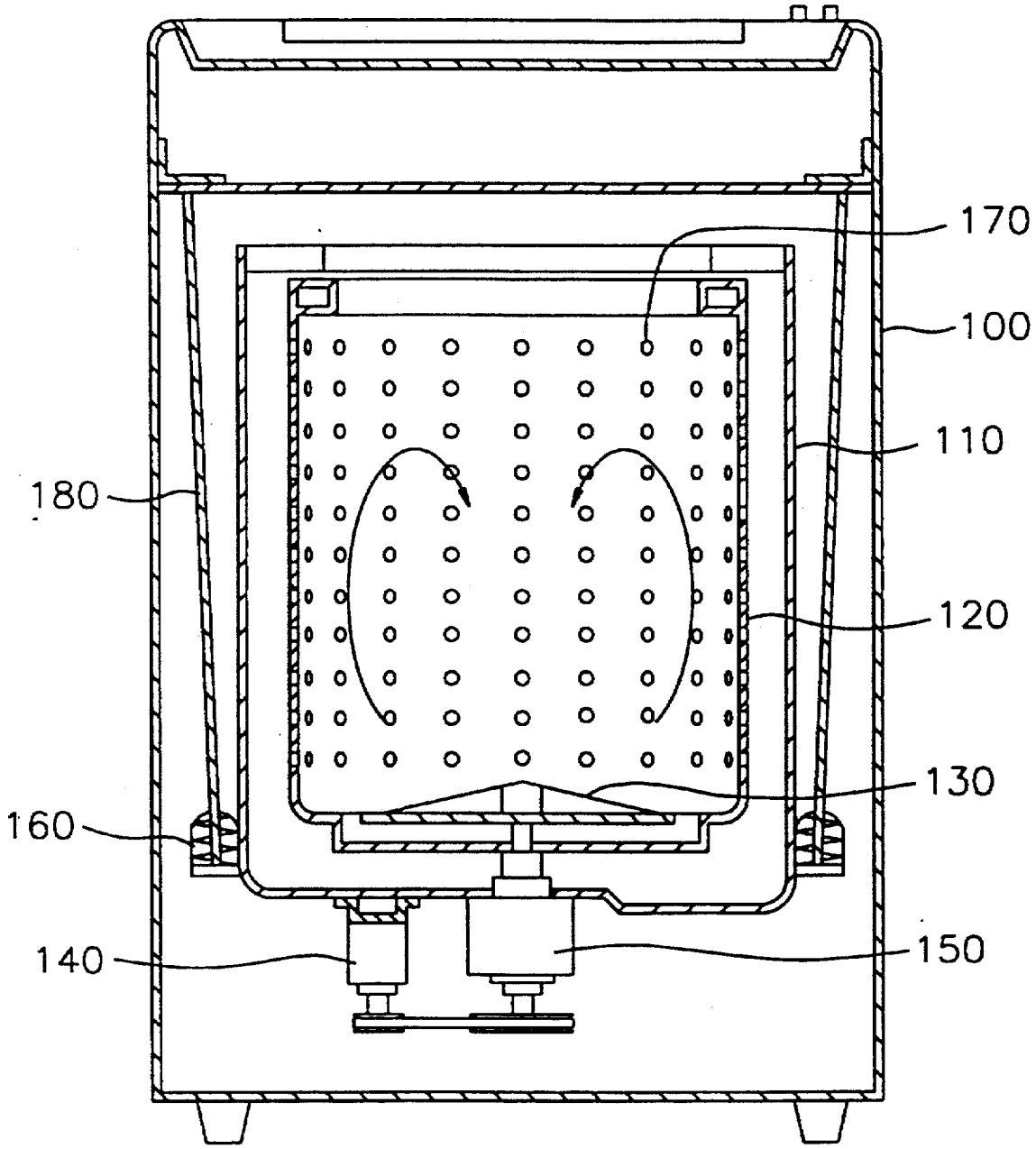
FIG. 1 PRIOR ART
FIG. 1 is a side sectional view of a conventional washing machine.
Figure 2:
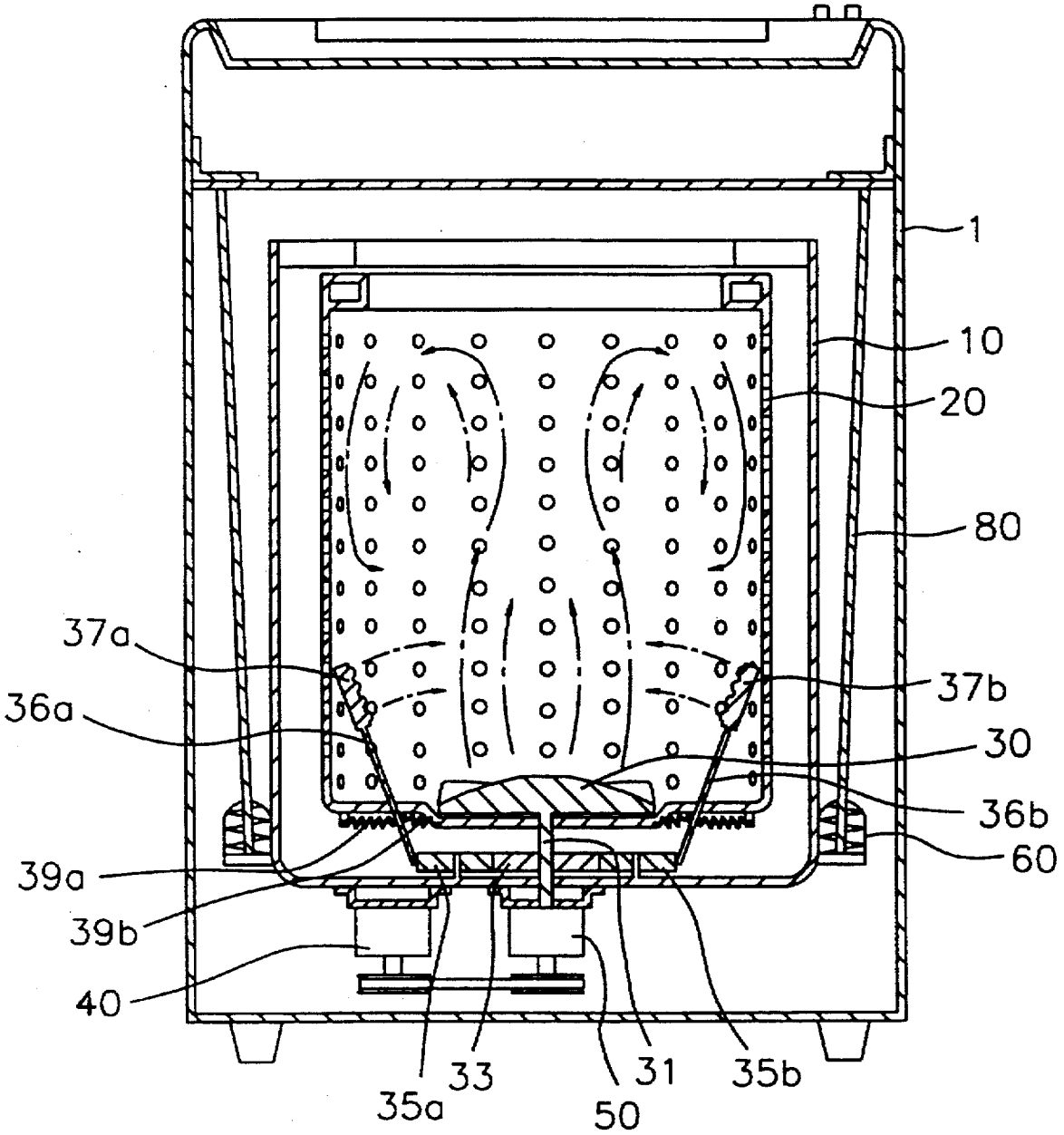
FIG. 2 is a side sectional view of a washing machine having an agitator according to the present invention.
Figure 3:
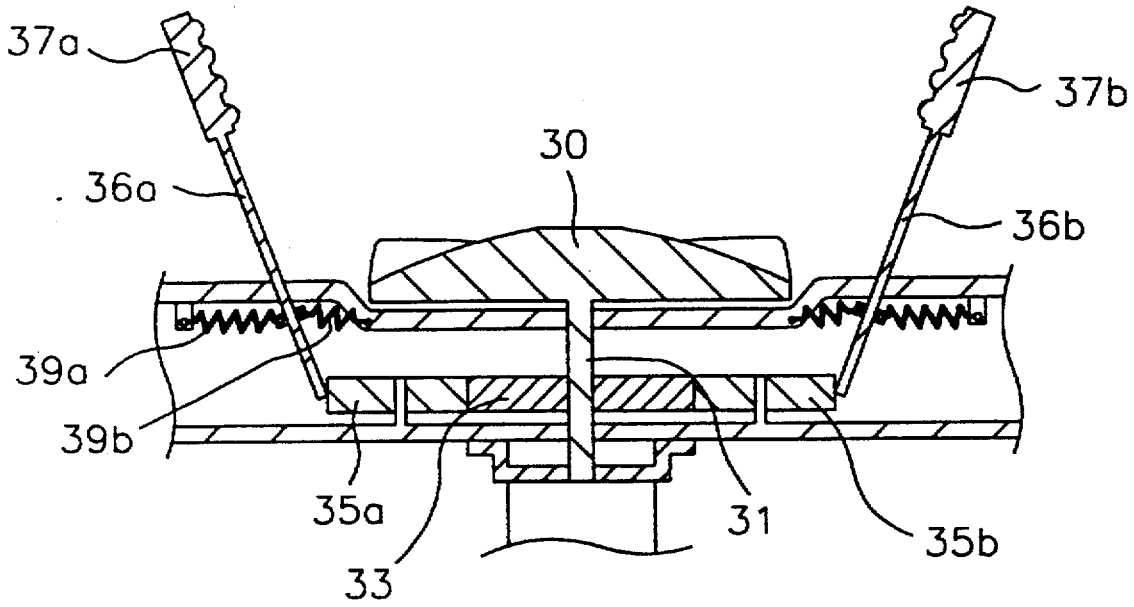
FIG. 3 is an enlarged view of an agitator of the washing machine in FIG. 2.
Figure 4:
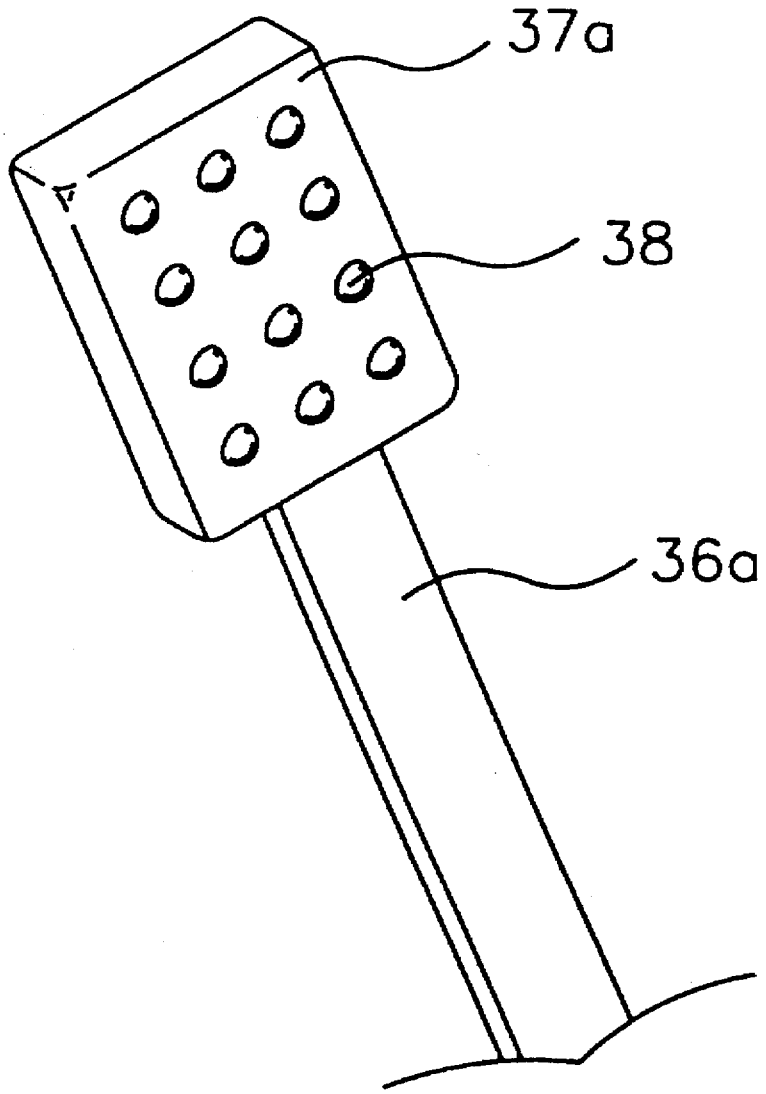
FIG. 4 is an enlarged perspective view of a plate for forming rotating water flow shown in FIG. 3.
Figure 5:
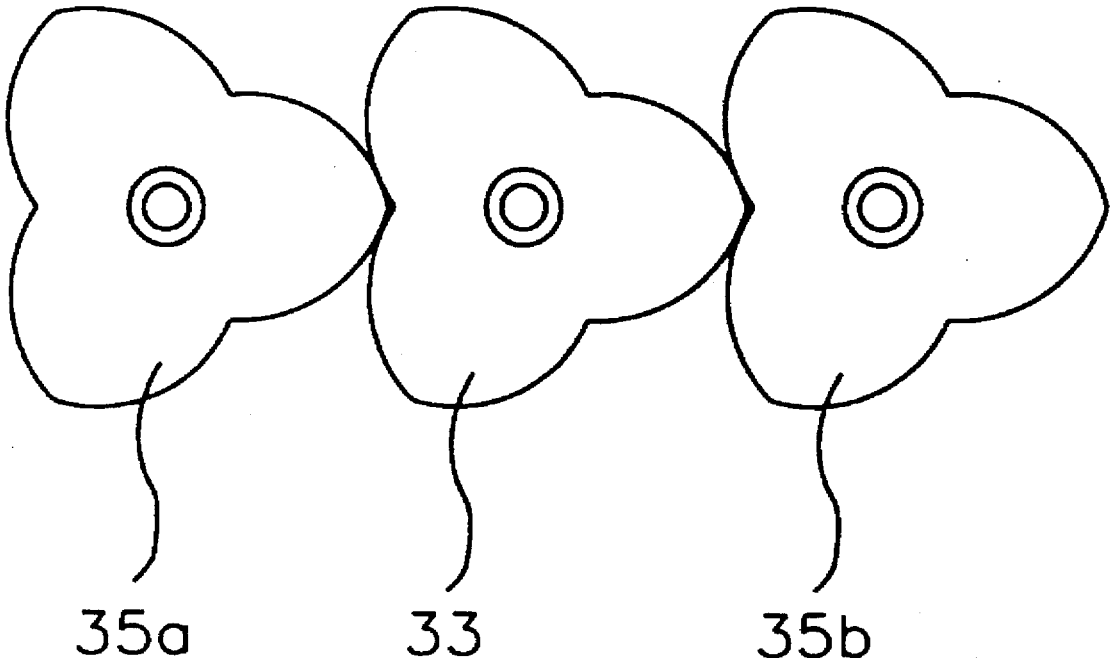
FIG. 5 is a top view of portion of a driving cam and a driven cam shown in FIG. 3.

FIG. 2 is a side sectional view of a washing machine having an agitator according to the present invention, and FIG. 3 is an enlarged view of an agitator of the washing machine in FIG. 2. As shown in these drawings, a washing machine having an agitator according to the present invention also has, like the conventional washing machine, an outer tub 10 installed in a casing 1, a washing tub 20 installed in the outer tub 10 for accommodating laundry and water, an agitator 30 which is installed on the bottom of the washing tub 20 to move the laundry and the washing water accommodated in the washing tub 20, a driving motor 40 disposed under the outer tub 10 for driving the agitator 30, and a gear assembly 50 for transmitting the power of the driving motor 40 selectively to the agitator 30 and the washing tub 20.

The outer tub 10 is suspended in the casing 1 by a suspending bar 80. The suspending bar 80 is connected to a damper 60 attached on a lower portion of a surface of the outer tub 10. The washing tub 20 is installed in the outer tub 10 rotatively. A plurality of holes 70 are formed on the wall of the washing tub 20. The agitator 30 installed on the bottom of the washing tub 20. The agitator 30 installed on the bottom of the washing tub 20 rotates clockwise and counterclockwise by the driving motor 40 the gear assembly 50.

And, an agitator for forming a rotating water flow in the washing tub 20 is installed at the lower portion of the washing tub 20. The agitator of washing machine in the present invention comprises a washing shaft 31 installed on a lower portion of a washing tub 20 and extending upward to a bottom of the washing tub 20 to be installed rotatively, a triangular-shaped driving cam 33 installed on the washing shaft 31 to rotate integrally with the washing shaft 31, a pair of driven cam **35*a*, 35*b* installed at 2 positions around the washing shaft 31 and contacting a surface of the driving cam 33 to be driven by rotation of the driving cam 33, a moving bars 36*a*, 36*b* of which one end contacts an outer surface of the driven cams 35*a*, 35*b* and the other end extends upward into the washing tub 20 through a hole formed on the bottom of the washing tub 20 such that the other end moves rotatively in the washing tub 20 through the gear assembly 50, so that the pulsator 30 in the washing tub 20 rotates by rotation of the washing shaft 31, thereby washing water flows are generated in the middle portion of the washing tub 20**.

At this time, the driving cam 33 rotates integrally by rotation of the washing shaft 31, and a pair of driven cams **35*a*, 35*b* contacting the driving cam 33 rotate together with the driving cam 33. When each of the driven cams 35*a*, 35*b* rotates, the moving bars 36*a*, 36*b* move rotatively right and left on hinge as the center criterion when the lower end portion of the moving bars 36*a*, 36*b* contacts the outer surface of the driven cams 35*a*, 35*b* tight. Therefore, the plates 37*a*, 37*b* for forming the rotating water flow move rotatively right and left in the washing tub 20 to form the rotating water flow. Accordingly, as designated by the direction of the arrow in FIG. 2, turbulent flows are generated by rotation of the pulsator 30 and moving of the plates 37*a*, 37*b* for forming the rotating water flow in the washing tub 20**, so that the turbulent flow prevents laundry from tangling.

That this time, the plates **37*a*, 37*b*** for forming rotating the water flow generate a turbulent flow and strike laundry simultaneously, so that washing efficiency is enhanced.

When the plates **37*a*, 37*b* for forming the rotating water flow move rotatively during washing process, the outer tub 10 vibrates hard. The vibration is alleviated by the damper 60 attached on the surface of the outer tub 10**.

In the above description and illustration, the driven cams **35*a*, 35*b* are installed at two positions around the washing shaft 31 respectively, and two moving bars 36*a*, 36*b* and two plates 37*a*, 37*b* for forming a rotating water flow are installed respectively. But, in the agitator according to the present invention, the driving cams 35*a*, 35*b* can be installed at three positions, preferably at 4 positions, around the washing shaft 31** to correspond with the number of driven cams, and the moving bar and the plate for forming rotating water flow can be installed.

As describe above, by the agitator of washing machine according to the present invention, irregular rotating water flows are generated to prevent laundry from gathering in the center of the washing tub. Accordingly, the washing time is shortened, and the washing efficiency is enhanced.

In the above, the present invention is described in detail by using the preferred embodiment, but the invention is not limited to the above embodiment. It should be obvious to people skilled in the conventional art that modifications can be made to the invention as described above without departing from the spirit or the scope of the invention. However the invention is limited by the accompanying claims as below.

What is claimed is:

1. An agitator of washing machine comprising:

a washing shaft installed on a lower portion of a washing tub and extending upward to a bottom of the washing tub to be installed rotatively;

a driving cam installed on the washing shaft to rotate integrally with the washing shaft;

a driven cam installed around the washing shaft and contacting a surface of the driving cam to be driven by rotation of the driving cam;

a moving bar of which one end contacts an outer surface of the driven cam and the other end extends upward into the washing tub through a hole formed on the bottom of the washing tub such that the other end moves rotatively in the washing tub by rotation of the driven cam;

a plate for forming a rotating water flow which is formed at the other end of the moving bar to move rotatively integrally with the moving bar, thereby forming the rotating water flow in the washing tub; and an elastic means for tightly pushing the one end of the moving bar onto the surface of the driven cam.

2. The agitator of washing machine as claimed in claim 1, wherein the driving cam has a triangular shape.

3. The agitator of washing machine as claimed in claim 2, wherein the driven cam is composed of at least a pair of triangular-shaped cams.

4. The agitator of washing machine as claimed in claim 3, wherein the driven cam is installed at 4 positions around the washing shaft.

5. The agitator of washing machine as claimed in claim 4, wherein the driven cam and the driven cams are positioned linearly on the driving cam as the center criterion.

6. The agitator of washing machine as claimed in claim 4, wherein the driven cam and the driven cams are positioned linearly on the driving cam as a center criterion.

7. The agitator of washing machine as claimed in claim 3, wherein the driven cams are installed at 4 positions around the washing shaft.

8. The agitator of washing machine as claimed in claim 1, wherein the moving bar moves rotatively on the middle portion between one end and the other end as a center criterion.

9. The agitator of washing machine as claimed in claim 1, wherein the plate for forming the rotating water flow has a plurality of projections on one surface.

10. The agitator of washing machine as claimed in claim 1, wherein the elastic means is installed at the middle portion of the moving bar.

11. The agitator of washing machine as claimed in claim 10, wherein the elastic means is a coil spring.

12. The agitator of washing machine as claimed in claim 11, wherein the coil spring is a pair of coil springs installed in opposite directions to each other.

13. The agitator of washing machine as claimed in claim 1, wherein the moving bar moves rotatively on the middle portion between one end and the other end as a center criterion.

14. An agitator of washing machine comprising:

a washing shaft installed on a lower portion of a washing tub and extending upward to a bottom of the washing tub to be installed rotatively;

a triangular-shaped driving cam installed on the washing shaft to rotate integrally with the washing shaft;

at least a pair of driven cams installed around the washing shaft and contacting a surface of the driving cam to be driven by rotation of the driving cam;

a moving bar of which one end contacts an outer surface of the driven cam and the other end extends upward into the washing tub through a hole formed on the bottom of the washing tub such that the other end moves rotatively in the washing tub by rotation of the driven cam;

a plate for forming a rotating water flow which is formed at the other end of the moving bar and a plurality of projections are formed on one surface to move rotatively integrally with the moving bar, thereby forming the rotating water flow in the washing tub; and an elastic means for tightly pushing the one end of the moving bar to tightly push the one end of the moving bar onto the surface of the driven cam.

15. The agitator of washing machine as claimed in claim 11, wherein the elastic means is a coil spring.

16. The agitator of washing machine as claimed in claim 15, wherein the coil spring is a pair of coil springs installed in opposite directions to each other.

* * * * *